US007016514B2

(12) United States Patent
White et al.

(10) Patent No.: US 7,016,514 B2
(45) Date of Patent: Mar. 21, 2006

(54) LOUDSPEAKER ASSEMBLY

(75) Inventors: Ian Stanley White, Ipswich (GB); Richard Carl Klein, Ipswich (GB)

(73) Assignee: KH Technology Corporation, Georgetown (KY)

( * ) Notice: Subject to any disclaimer, the term of this patent is extended or adjusted under 35 U.S.C. 154(b) by 72 days.

(21) Appl. No.: 10/061,139

(22) Filed: Feb. 1, 2002

(65) Prior Publication Data

US 2002/0106101 A1 Aug. 8, 2002

(30) Foreign Application Priority Data

Feb. 3, 2001 (GB) ..... 0102780

(51) Int. Cl.
*H04R 25/00* (2006.01)

(52) U.S. Cl. ..... 381/397; 381/398; 381/412; 381/416

(58) Field of Classification Search ..... 381/396, 381/397, 398, 412, 416, 400, 403, 404, 420, 381/421, 422; 181/171, 172; 335/222, 223
See application file for complete search history.

(56) References Cited

U.S. PATENT DOCUMENTS

| | | | |
|---|---|---|---|
| 1,808,297 | A | 6/1931 | Dempster et al. |
| 1,820,585 | A | 8/1931 | Tolerton et al. |
| 2,551,447 | A | 5/1951 | Marquis |
| 2,593,031 | A | 4/1952 | Howatt |
| 3,250,862 | A | 5/1966 | Rollins |
| 3,693,752 | A | 9/1972 | Kinoshita et al. |
| 4,131,180 | A | 12/1978 | Maeda |
| 4,356,881 | A | 11/1982 | Lowell |
| 4,737,992 | A | 4/1988 | Latham-Brown et al. |
| 5,040,221 | A | 8/1991 | Edwards et al. |
| 5,475,765 | A | 12/1995 | Lyth |
| 5,802,191 | A | 9/1998 | Guenther |
| 5,872,339 | A | 2/1999 | Hanson |

FOREIGN PATENT DOCUMENTS

| | | | |
|---|---|---|---|
| AU | 116646 | | 10/1941 |
| EP | 0624049 | A2 | 4/1994 |
| FR | 1.041.547 | | 9/1951 |
| GB | 400119 | | 10/1933 |
| GB | 2 108355 | A | 10/1981 |
| IE | 2607 390 | C2 | 2/1976 |
| IE | 28 42 999 | | 4/1980 |
| JP | 090018983 | A | 1/1997 |
| WO | PCT/US88/00685 | | 3/1988 |
| WO | PCT/SE97/01209 | | 7/1996 |

*Primary Examiner*—Huyen Le
(74) *Attorney, Agent, or Firm*—Kenneth L. Sherman, Esq.; Myers Dawes Andras & Sherman, LLP

(57) ABSTRACT

A loudspeaker assembly includes a chassis, a magnet assembly supported by the chassis and disposed at a rear side thereof, a moveable voice coil, a rear suspension, and a diaphragm connected to the voice coil and to the chassis. The assembly defines a voice coil gap receiving the voice coil. To improve the cooling of the assembly, particularly when the magnet assembly includes neodymium, the assembly is positioned at least substantially in front of the diaphragm, and the chassis is positioned outwardly of the magnet assembly. Heat generated by the coil, which could adversely affect the magnet, is dissipated by conduction to the chassis and by convection and radiation to ambient air. The rear suspension supports the voice coil, is secured to the assembly and is connected to the chassis only through the magnet assembly and through the diaphragm.

23 Claims, 2 Drawing Sheets

LOUDSPEAKER ASSEMBLY

BACKGROUND OF THE INVENTION

Field of the Invention

This invention relates to loudspeaker assemblies, and, more particularly, to permanent magnet moving coil loudspeaker assemblies.

In a permanent magnet moving coil loudspeaker, a chassis supports the magnet and the moving coil and diaphragm are suspended from the chassis. For many years, the chassis was positioned behind the cone or dome of the loudspeaker. However, as moving coil loudspeakers were used at increasingly higher power, the voice coil heated up rapidly, resulting in a drop in the power output, a reduced longevity, and limitation on power handling. The heat produced by the coil was transferred to the magnet and chassis, but, as the magnet and chassis were located within the speaker cabinet, this did not produce effective dissipation of the heat.

One attempt to meet this problem was to use larger coils, which, thus, increased the area from which heat could be transferred to the magnet and chassis. The increase helped to lower the coil temperature, but, because of their location within the speaker cabinet, the magnet and chassis still received the thermal output from the coil with little or no possibility of them being cooled.

An alternative method of dissipating the heat produced by the coil more efficiently is described in U.S. Pat. No. 5,475,765 to Lyth, in which the chassis is located in front of the diaphragm. The Lyth chassis includes a central hub, an annular outer flange, and spokes extending from the central hub to the flange. The rear of the hub carries the center pole of a ceramic magnet with front and rear suspensions for the diaphragm connected to the chassis. The ceramic magnet includes a center pole and a surrounding ring, with the voice coil movable in the gap between them. The magnet and the voice coil, which is the source of the heat, are both located behind the diaphragm.

U.S. Pat. No. 4,737,992 to Latham-Brown et al. discloses a loudspeaker assembly having a plastic basket with front and rear portions connected to one another. The magnet is disposed in the front portion of the basket and a voice coil assembly is disposed in the interior of the magnet. The diaphragm is connected to the front portion of the basket directly and is also indirectly connected thereto through the spider and the rear portion of the basket. The spider is directly connected to the rear portion of the basket and is indirectly connected to the front portion through the rear portion, through the diaphragm, and through the voice coil and magnet assemblies. The voice coil assembly is also indirectly connected to the front portion of the basket first through spider and rear portion, also through the diaphragm, and finally through the voice coil and magnet assemblies.

With the advent of permanent magnets that use or incorporate neodymium, the problem of heat dissipation has become more important. Neodymium magnets are very high energy magnets, as compared to ceramic magnets. Like ceramic magnets, it is also necessary for neodymium magnets to be kept cool because at typical voice coil operating temperatures the neodymium can demagnetize, resulting in a degradation of performance.

SUMMARY OF THE INVENTION

It is accordingly an object of the invention to provide a loudspeaker assembly that overcomes the hereinafore-mentioned disadvantages of the heretofore-known devices of this general type and that more effectively dissipates the heat produced by the coil, that substantially prevent heat from the coil from passing into the loudspeaker cabinet, and that keeps the magnet of the loudspeaker assembly relatively cool, thereby enabling the use of magnets of neodymium or incorporating neodymium.

With the foregoing and other objects in view, there is provided, in accordance with the invention, a loudspeaker assembly including a chassis having a rearward side, a magnet assembly defining a voice coil gap, the magnet assembly being supported by the chassis and disposed at the rearward side of the chassis, a moveable voice coil disposed within the voice coil gap, a diaphragm having a forward side, the diaphragm being connected to the voice coil and to the chassis, a rear suspension supporting the voice coil, a substantial portion of the magnet assembly being disposed at the forward side of the diaphragm, and the rear suspension secured to the magnet assembly and connected to the chassis only through the magnet assembly and through the diaphragm. Preferably, the magnet assembly is in surface contact with the chassis.

In accordance with another feature of the invention, a substantial portion of the magnet assembly and a substantial portion of the voice coil are disposed at the forward side of the diaphragm.

Both the chassis and at least substantially all of the magnet assembly are positioned in front of the diaphragm. Thus, necessarily, the coil, too, is located in front of the diaphragm. By such an inversion of the relative positions of the magnet and diaphragm, as compared, for example, with prior art assemblies, the magnet is no longer within the cabinet. Rather, it is in the ambient air and is more effectively cooled, both by conduction to the chassis and by convection and radiation.

In accordance with a further feature of the invention, the rear suspension is connected to the voice coil.

In accordance with an added feature of the invention, the voice coil has a rearward side and the rear suspension is connected to the rearward side of the voice coil.

In accordance with an additional feature of the invention, the diaphragm has an outer periphery and the diaphragm is connected to the chassis at the outer periphery.

In accordance with yet another feature of the invention, the magnet assembly has a rearward side, the diaphragm has a rearward end, a voice coil former is secured to the rearward end of the diaphragm; the voice coil is disposed on the voice coil former, the rear suspension has a dished support member with a periphery and a resilient suspension element connected between the periphery of the dished support member and the voice coil former, and the dished support member is secured to and projects away from the rearward side of the magnet assembly. Preferably, the dished support member is of a plastic material.

In accordance with yet a further feature of the invention, the diaphragm has an envelope defining a volume and the magnet assembly is disposed substantially within the volume.

Preferably, the magnet assembly includes neodymium. Alternatively, or additionally, the magnet assembly is of steel and neodymium.

In a preferred form, the magnet assembly includes a cup having its base in surface contact with the chassis and encompassing a central core with one or more rings of neodymium between the cup and the core. Preferably, the magnet assembly includes a sandwich of neodymium and steel rings between the cup and the core.

In accordance with yet an added feature of the invention, the chassis is of metal or metal alloy.

In accordance with yet an additional feature of the invention, the chassis has an annular outer ring, the outer periphery of the diaphragm has a circumferential surround, and an annular gasket sandwiches the circumferential surround to the annular outer ring. Preferably, the annular gasket is of a plastic material. Also, the circumferential surround is preferably fused to the annular gasket.

In accordance with again another feature of the invention, there is provided an abutting connection between the annular gasket and the annular outer ring.

In accordance with again a further feature of the invention, the magnet assembly has a rearward side and the rear suspension has two tandem support members secured to the rearward side of the magnet assembly. With such an assembly one can ensure that one or more rear suspension carriers providing support for the diaphragm are fixed to the rearward portion of the core.

With the objects of the invention in view, there is also provided a loudspeaker assembly including a chassis having a rearward side, a magnet assembly defining a voice coil gap, the magnet assembly being connected to the chassis at the rearward side of the chassis, a moveable voice coil disposed within the voice coil gap, a diaphragm having a forward side, the diaphragm being connected to the voice coil and to the chassis, a majority of the magnet assembly being disposed at the forward side of the diaphragm, a rear suspension connected to the magnet assembly and to the diaphragm, and the rear suspension connected to the chassis only through the magnet assembly and through the diaphragm.

With the objects of the invention in view, there is also provided a loudspeaker assembly including a chassis having a rearward side, a magnet assembly having a moveable voice coil, the magnet assembly being connected to the rearward side of the chassis, a diaphragm having a forward side, the diaphragm being connected to the voice coil and to the chassis, a majority of the magnet assembly being disposed at the forward side of the diaphragm, a rear suspension connected to the magnet assembly and to the diaphragm, and the rear suspension connected to the chassis only through the magnet assembly and through the diaphragm.

Other features that are considered as characteristic for the invention are set forth in the appended claims.

Although the invention is illustrated and described herein as embodied in a loudspeaker assembly, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
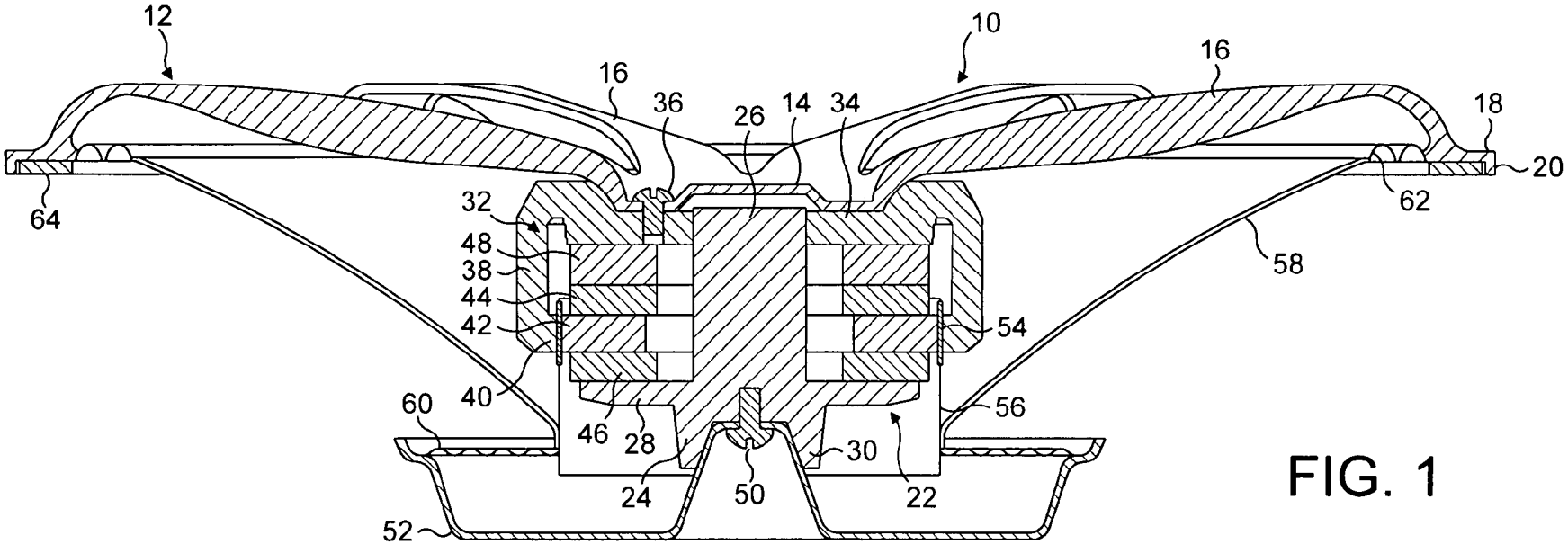
FIG. 1 is a cross-section of a loudspeaker assembly according to the invention.

Referring now to the figures of the drawings in detail and first, particularly to FIG. 1 thereof, there is shown a loudspeaker assembly 10 including a chassis 12 having a central disc 14 from which extend a number, for example six, of generally radial spokes 16. The spokes 16 are connected at their outer ends by an annular ring 18 having an inwardly directed lip 20. A lesser number of spokes, for example, three or four, may be preferred for certain loudspeakers.

The terms "inward," "outward," "inwardly," "outwardly," "forwardly," and "rearwardly" as used herein are intended to refer to the relationship of the assembly to the cabinet in which the speaker assembly 10 is to be mounted, i.e., the top of the drawings is the outward and forward side and the bottom of the drawings is the inward and rearward side.

The chassis spokes 16 are shaped to have longitudinally thickened but circumferentially thin portions in the center of the zones bridging the gap between the central disc 14 and the peripheral ring 18. The chassis 12 is preferably a metal casting, e.g., of aluminum.

The magnet assembly is indicated generally at 22. It is composed of steel and neodymium. The magnet assembly 22 includes a steel core 24 having a hub 26, a flange 28 towards its inward end, and a recessed boss 30. At the outward end of the hub 26 is mounted a steel cup 32. The base 34 of the cup is secured to the chassis central disc 14 by screws 36, so that there is surface-to-surface contact between the magnet and the chassis. The cup 32 has an outer circumferential wall 38 that terminates in an in-turned rib 40, which defines one side of a voice coil gap. Between the core flange 28 and the cup base 34 there is provided a sandwich of annular rings. A steel ring 42 is positioned so as to face the rib 40 and defines the other side of the voice coil gap. The ring 42 is flanked outwardly and inwardly by two neodymium rings 44, 46. A spacer ring 48 is positioned between the outward neodymium ring 44 and the base 34 of the cup 32.

A screw 50 fixes a dished rear suspension carrier 52 to the recessed boss 30 of the magnet core 24. The carrier 52 acts like a mini-chassis and is preferably of injection-molded plastics material, such as ABS. Alternatively, the carrier 52 could be vacuum formed.

Positioned in the voice coil gap between rib 40 and ring 42 is the voice coil 54, wound on a former 56 that extends inwardly from the voice coil windings. Secured to the inward end of the voice coil former 56 is a cone 58, for example of paper. A rear suspension 60, for example of impregnated woven cloth, extends radially between the inward end of the cone 58 and the margin of the dished rear suspension carrier 52.

The cone 58 extends outwardly from the rear suspension 52, behind the voice coil 54, the magnet assembly 22, and the chassis 12, and is secured to the outer ring 18 of the chassis through a surround 62, which can be, for example, of woven cloth. The surround 62 is shown held in place by a gasket 64 of plastics material fitted within the lip 20. The connection is preferably an abutting connection, and not a sealed connection, which makes it easier to take the connection apart for re-coning the assembly. Alternatively, the surround 62 can be heat fused to the gasket 64, i.e., the cloth is fused into the plastics material. Such a connection has been found to remove the "ticking" noises that are sometimes encountered.

In use, with the loudspeaker assembly 10 mounted in a cabinet, the chassis 12, the magnet assembly 22, and the voice coil 54 are all on the outside of the cone 58, in communication with the ambient air. In other words, a substantial portion of the magnet assembly 22 is on the outside of the cone 58. Preferably, more than half of the magnet assembly 22 is on the outside of the cone 58. In particular, substantially all of the magnet assembly 22 is on the outside of the cone 58. The magnet assembly is cooled by conduction to the chassis and by convection and radiation to the ambient air, as it is no longer confined to the cabinet. The chassis 12 is connected by screws 36 to what would previously have been considered the back of the magnet assembly 22, i.e., the base of the cup 32. Thus, the magnet assembly 22 can be regarded as inverted.

Figure 2:
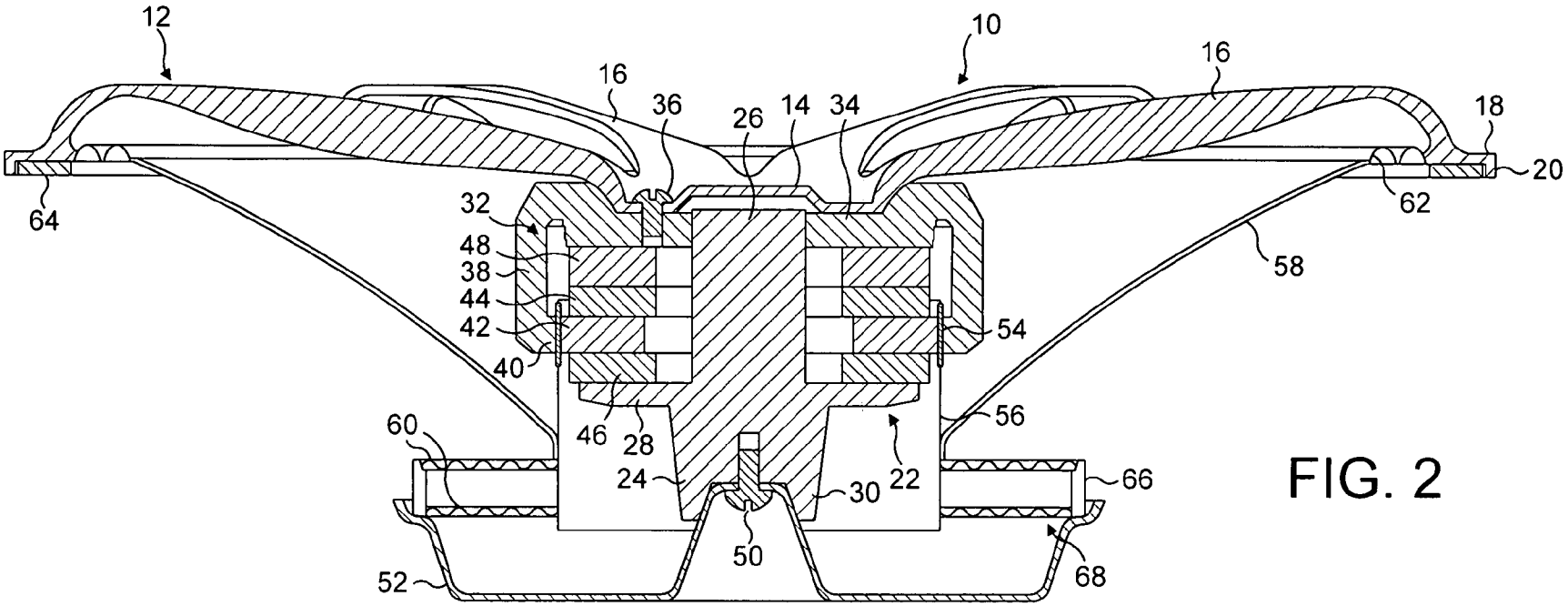
FIG. 2 is a cross-section of a loudspeaker assembly of FIG. 1 with a tandem suspension.

In a modified embodiment illustrated in FIG. 2, two rear suspensions 60 can be disposed in tandem. The two suspensions 60 can be connected to one another by a suspension ring 66. Thus, taken together, the two suspensions 60 and the ring 66 form a suspension assembly 68. Of course, other configurations and variations for the carrier and suspension(s) can also be provided.

It is to be emphasized that although the loudspeaker assembly of the invention is particularly suited to use with magnets of or for incorporating neodymium, it is not limited to the use of such magnets. The structural configuration, whereby effective cooling is achieved, can be used with magnets of any type. Significant advantages of the invention are achieved by the magnet assembly being located at least substantially in front of the cone, with the chassis positioned outwardly of the magnet assembly.

Although, in the illustrated embodiments, the magnet assembly 22 is located wholly within the volume defined by an envelope of the cone 58, the invention can still provides advantages, albeit with some diminution of the cooling capacity, if the magnet assembly is located rearwardly of the position illustrated, i.e., with a part of its structure extending through the aperture defined by the inward end of the cone, but still substantially within the envelope of the cone. Such a configuration is to be regarded as being within the scope of the invention.

Additionally, if the invention is used with shallow loudspeakers, having for example a flat cone, the magnet assembly and chassis will then protrude forwardly beyond the envelope of the cone, but will still be in front of the cone.

We claim:

1. A loudspeaker assembly, comprising:

a chassis having a rearward side;

a magnet assembly defining a voice coil gap, said magnet assembly: supported by said chassis; and disposed at said rearward side of said chassis;

a moveable voice coil disposed within said voice coil gap;

a diaphragm having a forward side, said diaphragm connected to said voice coil and to said chassis;

a rear suspension supporting said voice coil;

a substantial portion of said magnet assembly disposed at said forward side of said diaphragm; and said rear suspension secured to said magnet assembly and connected to said chassis only through said magnet assembly and through said diaphragm.

2. The loudspeaker assembly according to claim 1, wherein said voice coil has a rearward side and said rear suspension is connected to said rearward side of said voice coil.

3. The loudspeaker assembly according to claim 1, wherein said diaphragm has an outer periphery and said diaphragm is connected to said chassis at said outer periphery.

4. The loudspeaker assembly according to claim 3, wherein:

said chassis has an annular outer ring; said outer periphery of said diaphragm has a circumferential surround; and an annular gasket sandwiches said circumferential surround to said annular outer ring.

5. The loudspeaker assembly according claim 4, wherein said annular gasket is of a plastic material.

6. The loudspeaker assembly according to claim 4, wherein a connection between said annular gasket and said annular outer ring is an abutting connection.

7. The loudspeaker assembly according to claim 4, wherein said circumferential surround is fused to said annular gasket.

8. The loudspeaker assembly according to claim 1, wherein:

said magnet assembly has a rearward side;

said diaphragm has a rearward end;

a voice coil former is secured to said rearward end of the diaphragm;

said voice coil is disposed on said voice coil former;

said rear suspension has: a dished support member with a periphery; and a resilient suspension element connected between said periphery of said dished support member and said voice coil former; and said dished support member is secured to and projects away from said rearward side of said magnet assembly.

9. The loudspeaker assembly according to claim 8, wherein said dished support member is of a plastic material.

10. The loudspeaker assembly according to claim 1, wherein:

said diaphragm has an envelope defining a volume; and said magnet assembly is disposed substantially within said volume.

11. The loudspeaker assembly according to claim 1, wherein said magnet assembly is of neodymium.

12. The loudspeaker assembly according to claim 1, wherein said magnet assembly is of steel and neodymium.

13. The loudspeaker assembly according to claim 1, wherein said magnet assembly has:

a central core;

a cup with a base contacting said chassis, said cup encompassing said central core; and at least one neodymium ring disposed between said cup and said central core.

14. The loudspeaker assembly according to claim 13, wherein:

said magnet assembly has a plurality of sandwiched rings including said at least one neodymium ring and at least one steel ring; and said plurality of rings is disposed between said cup and said core.

15. The loudspeaker assembly according to claim 1, wherein said chassis is of one of the group consisting of metal and metal alloy.

16. The loudspeaker assembly according to claim 1, wherein:

said magnet assembly has a rearward side; and said rear suspension has two tandem support members secured to said rearward side of said magnet assembly.

17. The loudspeaker assembly according to claim 1, wherein said magnet assembly is in surface contact with said chassis.

18. A loudspeaker assembly, comprising:

a chassis having a rearward side;

a magnet assembly defining a voice coil gap, said magnet assembly: supported by said chassis; and disposed at said rearward side of said chassis;

a moveable voice coil disposed within said voice coil gap;

a diaphragm having a forward side, said diaphragm connected to said voice coil and to said chassis;

a rear suspension supporting said voice coil;

a substantial portion of said magnet assembly and a substantial portion of said voice coil disposed at said forward side of said diaphragm; and said rear suspension secured to said magnet assembly and connected to said chassis only through said magnet assembly and through said diaphragm.

19. A loudspeaker assembly, comprising:

a chassis having a rearward side;

a magnet assembly defining a voice coil gap, said magnet assembly connected to said chassis at said rearward side of said chassis;

a moveable voice coil disposed within said voice coil gap; a diaphragm having a forward side, said diaphragm connected to said voice coil and to said chassis;

a majority of said magnet assembly disposed at said forward side of said diaphragm;

a rear suspension connected to said magnet assembly and to said diaphragm; and said rear suspension connected to said chassis only through said magnet assembly and through said diaphragm.

20. The loudspeaker assembly according to claim 19, wherein said rear suspension is connected to said voice coil.

21. The loudspeaker assembly according to claim 19, wherein said voice coil has a rearward side and said rear suspension is connected to said rearward side of said voice coil.

22. The loudspeaker assembly according to claim 19, wherein said diaphragm has an outer periphery and said diaphragm is connected to said chassis at said outer periphery.

23. A loudspeaker assembly, comprising:

a chassis having a rearward side;

a magnet assembly having a moveable voice coil, said magnet assembly connected to said rearward side of said chassis;

a diaphragm having a forward side, said diaphragm connected to said voice coil and to said chassis;

a majority of said magnet assembly disposed at said forward side of said diaphragm;

a rear suspension connected to said magnet assembly and to said diaphragm; and said rear suspension connected to said chassis only through said magnet assembly and through said diaphragm.

* * * * *